United States Patent [19]

Marcus

[11] Patent Number: 4,553,797

[45] Date of Patent: Nov. 19, 1985

[54] MOUNTING BRACKET

[75] Inventor: Konrad H. Marcus, Holland, Mich.

[73] Assignee: Prince Corporation, Holland, Mich.

[21] Appl. No.: 341,284

[22] Filed: Jan. 21, 1982

[51] Int. Cl.[4] ..... H01R 39/00

[52] U.S. Cl. ..... 339/22; 296/97 H; 339/5 R

[58] Field of Search ..... 296/97 H; 339/2 A, 2 L, 339/5 A, 6 R, 6 H, 8 R, 8 A, 182, 183; 403/329

[56] References Cited

U.S. PATENT DOCUMENTS

| | | | |
|---|---|---|---|
| 2,229,084 | 1/1941 | Horne | 403/329 X |
| 2,357,974 | 9/1944 | Roberts | 248/289 |
| 2,520,739 | 8/1950 | Shaw | 403/329 X |
| 2,939,741 | 6/1960 | Keating et al. | 296/97 |
| 3,150,896 | 9/1964 | Plattner | 296/97 |
| 3,289,149 | 11/1966 | Pawloski | 339/182 R X |
| 3,399,923 | 9/1968 | Bornefeld et al. | 296/97 |
| 3,477,678 | 11/1969 | Icke et al. | 248/288 |
| 3,585,575 | 6/1971 | De Vito | 339/182 R |
| 3,767,256 | 10/1973 | Sarkees | 296/97 K |
| 4,023,856 | 5/1977 | DeRees | 296/97 R |
| 4,148,519 | 4/1979 | Hollar | 296/97 H |
| 4,165,147 | 8/1979 | Buck | 339/182 R |
| 4,178,035 | 12/1979 | Cziptschirsch | 296/97 K |
| 4,352,518 | 10/1982 | Prince et al. | 296/97 H |
| 4,377,020 | 3/1983 | Vigo | 16/329 |

FOREIGN PATENT DOCUMENTS

| | | |
|---|---|---|
| 1965143 | 7/1970 | Fed. Rep. of Germany . |
| 7415154 | 8/1974 | Fed. Rep. of Germany . |
| 7531982 | 2/1976 | Fed. Rep. of Germany . |
| 2341940 | 6/1978 | Fed. Rep. of Germany . |
| 1251479 | 10/1971 | United Kingdom . |

*Primary Examiner*—Eugene F. Desmond

*Attorney, Agent, or Firm*—Price, Heneveld, Huizenga & Cooper

[57] ABSTRACT

A visor rod mounting bracket has a base with a collar having an opening therein for receiving a rod. The collar integrally includes a sidewall having an aperture extending therethrough and communicating with the opening and locking means mounted to either the base or collar and extending into the opening for lockably securing the visor rod therein. In one embodiment, the locking means comprises a leaf spring made of a conductive material which electrically engages the visor rod to provide an electrical contact thereto permitting the application of electrical operating power to the visor through the rod serving as one conductor.

15 Claims, 4 Drawing Figures

MOUNTING BRACKET

BACKGROUND OF THE INVENTION

The present invention relates to a mounting bracket and particularly one for mounting a visor support rod to a vehicle.

Rods, typically, employed for mounting visors to a vehicle are mounted to the headliner of a vehicle by a bracket and elbow assembly in which the elbow is pivotally mounted to the bracket by a shaft member extending through an opening in the elbow and secured therein by a backing washer and spring. U.S. Pat. No. 4,075,468 discloses such structure. Recently, efforts have been made to improve on this construction and U.S. Pat. No. 4,352,518, issued Oct. 5, 1982, and entitled VISOR discloses a system in which the visor rod itself is mounted directly within a mounting bracket and secured therein by the utilization of a set screw. Both of these systems permit rotation of the visor from a position over the windshield to a position approximately 90° therefrom and over a side window of a vehicle. With electrically illuminated visors, it is necessary to provide electrical energy to the illumination source therefore, and, typically, this has been achieved by utilization of hollow elbow assembly through which wires can be trained. The later identified structure, however, does not permit such application of electrical energy since the visor rod used therein is a solid member.

SUMMARY OF THE INVENTION

In order to overcome the deficiencies of the above identified prior art and also to provide a visor mounting bracket which permits rapid and easy installation of a visor to a vehicle, the system of the present invention provides a mounting bracket having a base with a collar having an opening therein for receiving a rod. The collar integrally includes a sidewall having an aperture extending therethrough and communicating with the opening and locking means mounted to either the base or collar and extending into the opening for lockably securing the visor rod therein. With such structure, the visor assembly can be snap-fitted within the visor mounting bracket during manufacture of the vehicle or as an after market item. Further, in one embodiment of the present invention, the locking means comprises a leaf spring made of a conductive material which electrically engages the visor rod to provide an electrical contact thereto permitting the application of electrical operating power to the visor through the rod serving as one conductor. These and other features, objects and advantages of the present invention will become apparent upon reading the following description thereof together with reference to the accompanying drawings in which:

DETAILED DESCRIPTION OF THE PREFERRED EMBODIMENT

Figure 1:
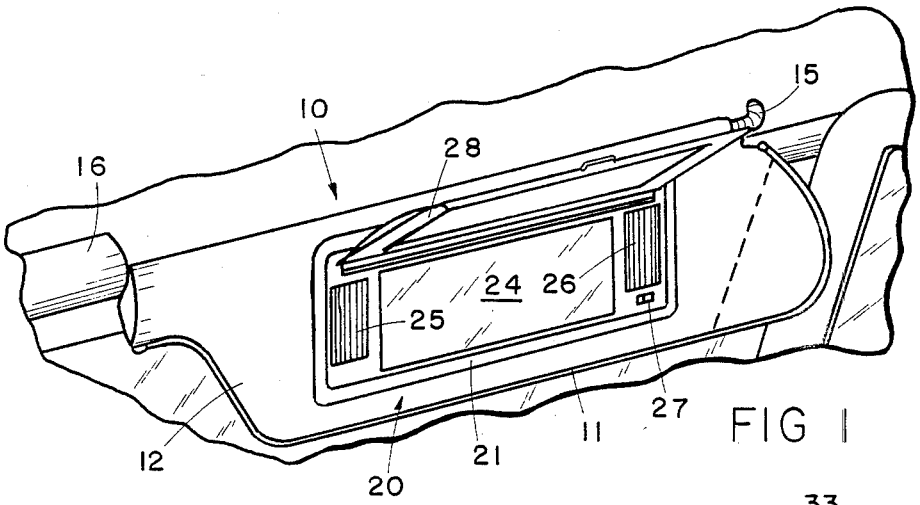
FIG. 1 is a fragmentary perspective view of a visor assembly incorporating a mounting bracket of the present invention.

Referring initially to FIG. 1, a visor assembly 10 incorporating the present invention is shown installed on the passenger side of vehicle. Assembly 10 comprises a visor body 12 made of a core member comprising two halves injection molded of a suitable polymeric material such as polypropylene joined along a hinge and subsequently snap-locked together by means of latches spaced at various locations along the core halves in mating opposed relationship locked together during assembly to form the visor body. This construction is disclosed in greater detail in the above identified pending patent application, the disclosure of which is incorporated herein by reference.

The visor body includes a rectangular recess (not shown) for receiving therein a visor mirror frame assembly 20. The visor body is covered by a suitable upholstery material, or the core is textured to conform to the upholstery of the vehicle interior and is trimmed along the edge by a suitable trim bead 11. A post extends from the left end (as viewed in FIG. 1) of the visor to detachably couple this end of the visor to a centrally located bracket 16 positioned in the headliner of a vehicle. The opposite end of the visor assembly includes a visor rod 15 which extends into a concealed visor rod mounting bracket 30 (FIGS. 2–4) secured to the vehicle headliner under the upholstery material as described in detail below in connection with FIGS. 2 through 4.

The visor mirror assembly 20 comprises a generally rectangular frame 21 into which there is secured a mirror 24. On opposite sides of mirror 24, there is provided a pair of lenses 25 and 26 behind each of which there are provided electrical lamps for illumination. Power is applied from the vehicle's electrical system to the lamps through switch means associated with cover 28 and a bright-dim switch 27 for directing illumination in a converging manner outwardly from the mirror 24. The mirror is selectively covered and the lamps selectively actuated by a snap open cover 28. The mirror and frame construction of assembly 20 is described more fully in U.S. Pat. No. 4,213,169, entitled COVERED VISOR MIRROR which is assigned to the present assignee and the disclosure of which is incorporated herein by reference.

Having briefly described the overall visor construction, a detailed description of the unique mounting of the visor to the vehicle through the visor mounting bracket 30 used also for providing electrical operating power to the illumination means is now described in connection with FIGS. 2 through 4.

Figure 2:
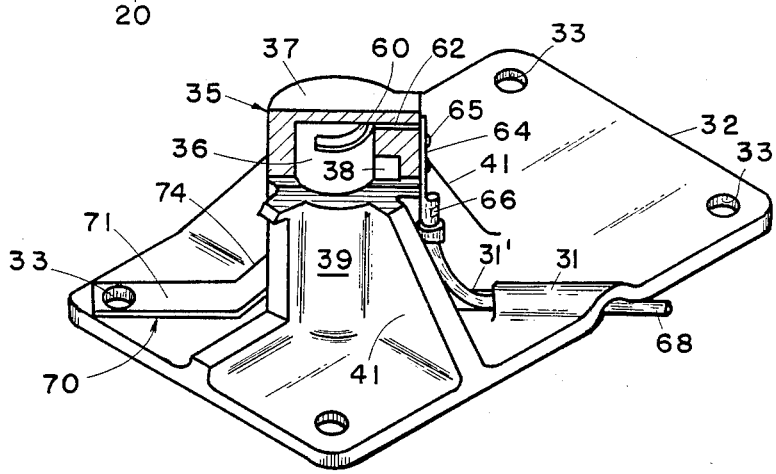
FIG. 2 is an enlarged fragmentary perspective and exploded view of the mounting bracket and visor rod of FIG. 1 shown partly broken away.
Figure 2:
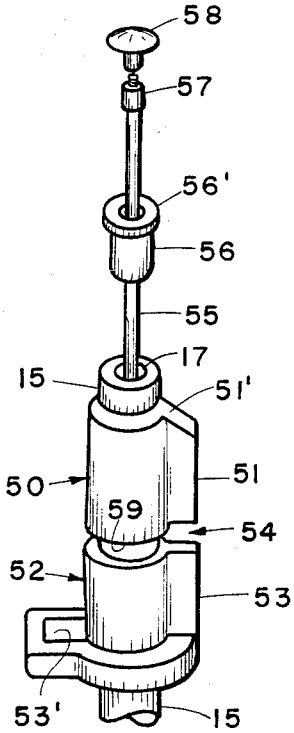
Figure 4:
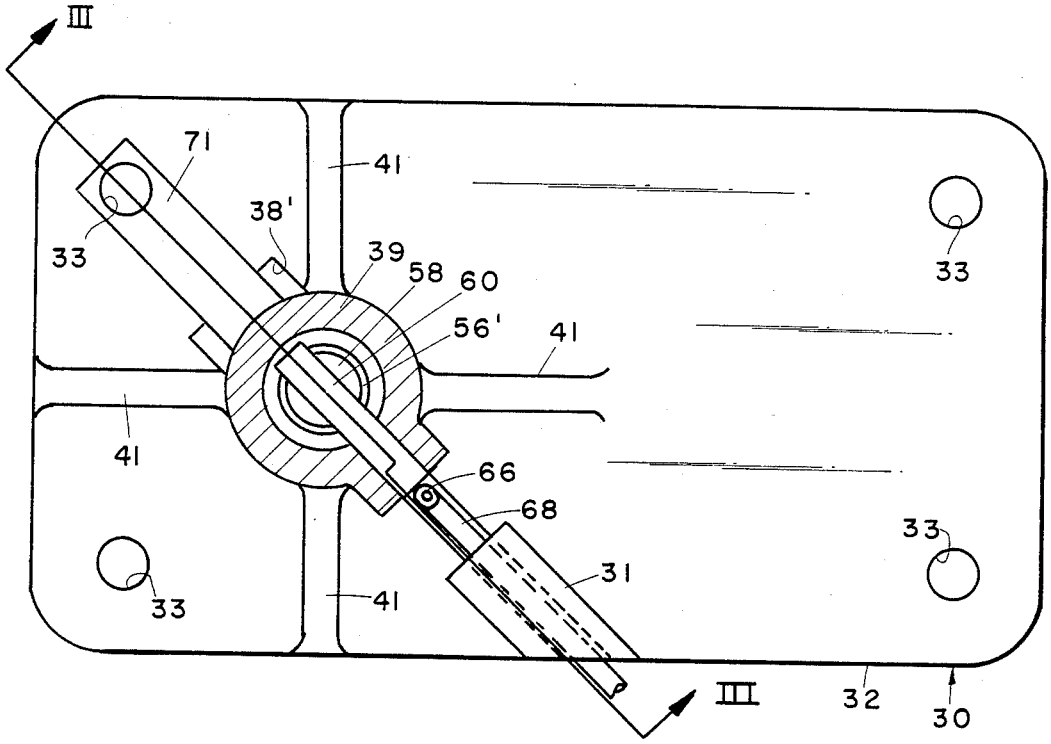
FIG. 4 is a cross-sectional view of the structure shown in FIG. 3 taken along section line IV—IV of FIG. 3.
Figure 3:
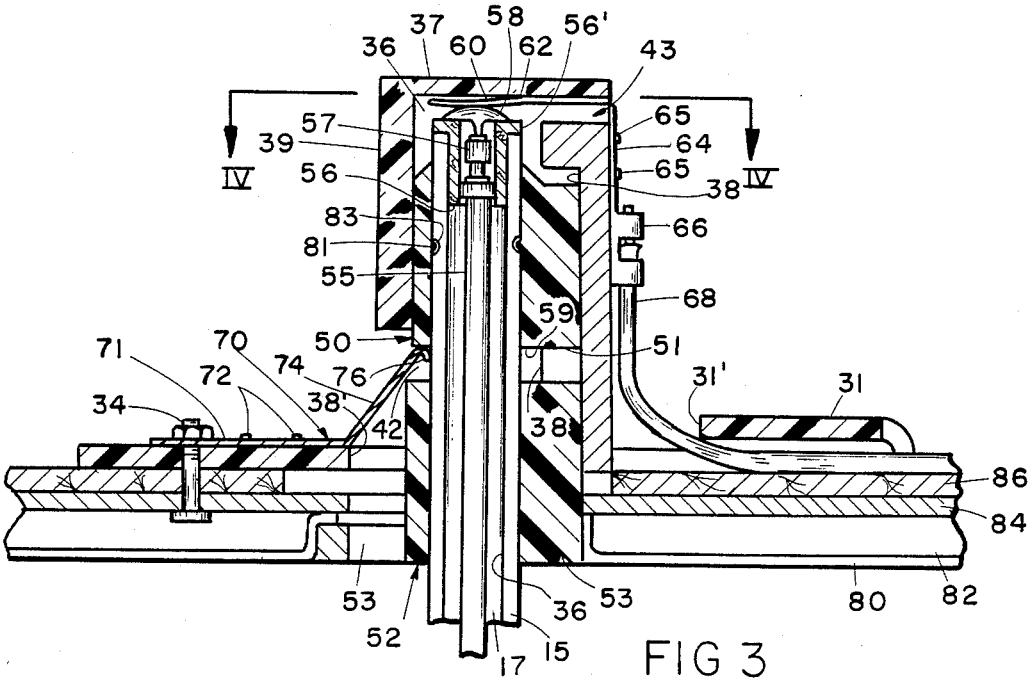
FIG. 3 is an enlarged cross-sectional view of the mounting bracket shown in FIG. 2 shown in an assembled position and taken along section line III—III of FIG. 4.

As seen in FIGS. 2 through 4, mounting bracket 30 includes a base or support flange 32 which is generally rectangular and includes aperture 33 at each of its corners for securing the bracket to the headliner of a vehicle by fastening means such as bolts 34 (FIG. 3). Bracket 30 integrally includes a rod receiving member 35 comprising a collar having a central opening 36 extending upwardly through base 32 and collar 35 for receiving the end of visor rod 15, bent at 90° as seen in FIG. 1 to extend within the top edge of the visor body with the opposite end mounted within with the opposite end mounted within bracket 30 as best seen in FIG. 3. In the preferred embodiment of the invention, collar 35 has an enclosed upper end 37 and a generally cylindrical opening 36 with a keyway 38 (FIGS. 2 and 3) formed vertically along the inner sidewall 39 of the collar for lockably securing flange portions 51 and 53 of torque fittings 50 and 52, respectively, associated with rod 15, as described more fully hereinafter. In the preferred embodiment of the invention, the bracket, including collar 35, is integrally molded with base 32 from a polymeric material such as polycarbonate which is suitable for the automotive environment. Four support fillets 41 spaced at equal intervals around the cylindrical collar 35 provides structural support for the collar with respect to base 32. Sidewall 39 of the collar includes a first aperture 42 (FIG. 3) extending therein and communicating with opening 36 and a second aperture 43 near the top thereof and also communicating with opening 36. A third aperture 38' extends through base 32 and is aligned with aperture 53' of fitting 52 for a purpose disclosed below.

Visor rod 15 is, as seen also in FIG. 1, a continuous hollow member with a right-angle bend after it extends from the visor body defining an end portion to which a pair of axially spaced torque fittings 50 and 52 are mounted. These torque fittings are of the type described in the above identified copending application and comprise a heat shrunk polymeric material such as an acetal molded onto the end of visor rod 15 in the position shown in FIGS. 2 and 3 to provide a predetermined rotational torque between rod 15 and fittings 50 and 52 which are lockably secured against rotation within keyway 38 of collar 35 by means of flanges 51 and 53 integrally formed on fittings 50 and 52 respectively. As seen in FIG. 2, there exists an axially extending gap 54 between torque fittings 50 and 52 which gap serves as interlocking means in cooperation with the mounting bracket for locking the end of visor rod 15 in position as described below.

Visor rod 15 is hollow including a central opening 17 extending therealong for receiving an electrical conductor 55 trained within the rod and serving as the positive electrical supply conductor for lamps associated with the visor. A bushing 56 made of an insulating material serves as a spacer and surrounds an electrical crimp terminal 57 which secures the end of conductor 55 to a button-shaped electrical contact 58. Bushing 58 includes an enlarged disk-shaped head 56' which seats against the end of visor rod 15 as best seen in FIG. 3 to insulate fitting 57 and contact 58 from the electrically conductive rod 15. When rod 15 is secured within mounting bracket 30, contact 58 engages an electrical contact 60 comprising a strip of electrically conductive material such as beryllium copper bent at 62 to deflect downwardly slightly to provide a spring loaded wiping electrical contact against convexly curved contact 58. Contact 60 extends outwardly through aperture 43 in sidewall 39 of collar 35 and has a downwardly extending leg 64 secured to the sidewall by means of fastening screws 65. Contact 60 terminates in a crimp fitting 66 to which an electrical supply conductor 68 is coupled and which leads to the positive voltage supply of the vehicle. Conductor 68 is trained through a concavely curved sleeve 31 integrally formed in base 32 through an opening 31' adjacent the sidewall of the collar.

In order to lockably secure the end of visor rod 15 within the mounting bracket, locking means 70 are provided and comprise in the preferred embodiment a leaf spring havine one end 71 secured to the base 32 by rivets 72 or the like and an opposite end 74 inclined upwardly and including a interengaging curved end 76 extending within aperture 42 in collar 35 and biased against rod 15, as best seen in FIG. 3. Member 70 is made of an electrically conductive material such as beryllium copper to provide a spring biasing force against the visor rod 15 as well as provide electrical contact with the rod through the physical contact between tip 76 and the outer cylindrical surface of the rod in the space or gap 54 between torque fittings 50 and 52. As best seen in FIG. 3, end 76 engages the lower generally cylindrical surface 59 of fitting 50 to prevent fitting 50 and rod 15 secured thereto from moving axially out of the mounting bracket 30. If necessary, fitting 50 and rod 15 can include an interengaging annular ring and depression 81 and 83, respectively (FIG. 3) to prevent axial movement of the fitting when molded on rod 15.

The visor rod mounting bracket is installed underneath the upholstery fabric 80 and the foam backing layer 82, and to the metallic headliner stamping 84 and backing material 86 of a vehicle by bolts 34 extending through the aperture 33 and the flange 32. Collar 35 extends generally upwardly toward the roof of the vehicle and has an axial dimension sufficiently short to fit within the clearance provided and yet sufficiently long to provide structural support for the end of the visor rod 15. During installation, conductor 68 is trained along the vehicle headliner to an appropriate electrical supply buss as, for example, through the windshield molding such that electrical operating power can be applied to conductor 55 through contact 58. The utilization of conductive fastening bolts 34 which extend through the metallic stamping 84 comprising the vehicle headliner provides the remaining ground or negative supply terminal to visor rod 15 through arm 70 such that both positive and negative supply conductors are provided to the visor assembly for the illumination means associated therewith. Naturally, if layer 84 is of a nonconductive material, an additional wire must be secured to latching means 70 by a suitable interconnection thereto to provide the ground return path.

With the mounting bracket 30 installed, the visor can be installed simply by inserting the end of visor rod 15 into the socket so formed until the end 76 of latching means 70 snap engages the rod through gap 54 to snap-lock the visor rod in position. During installation, the tapered leading surface 51' of torque member 50 allows end 76 of locking member to ride over the torque member 50 relatively easily until it reaches the gap 54 and snap locks against the outer cylindrical surface of visor rod 15 with the contact end 58 of the rod seated against contact 60. Removal of a visor is facilitated by inserting a suitable tool through apertures 53' and 38' to deflect locking member segment 74 counter-clockwise as viewed in FIG. 3, such that end 76 will clear fitting 50.

Thus, visor installation during assembly in an automotive production line becomes a very simple procedure as can after market installation of a lighted visor as an accessory when bracket 30 is installed as original equipment. Mounting bracket 30 can be employed with either lighted or unlighted visors. With unlighted visor assemblies, the electrical conductor 55 within the visor rod is not employed, but the mechanical innerconnection of the visor rod to the mounting bracket is substantially identical. The conductive latching means 70 functions as a slip ring connection with the visor rod as the visor is moved from the forward position against the vehicle windshield to its side window position. This provides continuous electrical contact for the ground return for the lighted visor while contacts 58 and 60 provide the movable contact for the positive supply conductor (in a negative ground system).

It will become apparent in those skilled in the art that various modifications of the preferred embodiment of the invention described herein can be made. The mounting bracket can be incorporated with lighted or unlighted visor assemblies or used for mounting rod-shaped objects different than the specific visor rod of the preferred embodiment. Further, the visor assembly itself may be of different configurations. In some embodiments of the invention, a single torque fitting or other locking means associated with the visor or other rod may be employed to interengage the locking means associated with the mounting bracket for locking the rod within the mounting bracket. These and other modifications to the preferred embodiment of the invention will, however, fall within the spirit or scope of the invention as defined by the appended claims.

The embodiments of the invention in which an exclusive property or privilege is claimed are defined as follows:

1. A visor rod mounting bracket comprising:

flange means including means for mounting said flange means to a vehicle;

a support collar fixedly secured to said flange means and having a sidewall defining a generally cylindrical opening for securing a rod end therein;

a visor rod having a molded torque fitting on an end thereof, said fitting shaped to extend within said collar opening and including a radially extending flat for locking said rod in said collar; and a locking arm having one end secured to one of said flange means or collar and including an end engaging said flat on said torque fitting for holding said rod end within said collar.

2. The apparatus as defined in claim 1 wherein said locking arm comprises a moveable arm.

3. The apparatus as defined in claim 2 wherein said arm comprises a leaf spring.

4. A visor rod and mounting bracket assembly comprising:

a mounting bracket having flange means including means for mounting said flange means to a vehicle and a support collar integrally formed with said flange means and defining a generally cylindrical opening for securing a rod end therein;

a visor rod having a cross section shaped to permit extension of an end thereof into said opening of said collar, said rod including means defining a radially extending flat for locking said rod within said collar; and locking means having one end coupled to said flange means and extending to lockably engage said flat of said rod when positioned within said cylindrical opening for holding said rod therein.

5. The apparatus as defined in claim 4 wherein said means defining a flat includes interengaging means coupled to said rod and wherein said locking means comprises a moveable arm extending to engage said interengaging means to hold said rod in said collar.

6. The apparatus as defined in claim 5 wherein said arm comprises a leaf spring and said interengaging means comprises a torque fitting with a surface defining said flat which is engaged by an end of said leaf spring.

7. A visor mounting bracket and rod assembly for mounting an illuminated visor to a vehicle and for providing an electrical connection to said visor, said assembly comprising:

a base including a rod receiving collar having a sidewall, said collar having an opening shaped to receive a rod therein and an aperture extending through said sidewall and communicating with said opening;

a visor rod for mounting a visor to the vehicle, said rod having a cross-section shaped to permit extension of an end thereof into said opening of said collar; and electrically conductive means extending into said opening to electrically contact said rod inserted into said collar and for lockably securing said rod within the collar.

8. The apparatus as defined in claim 7 wherein said rod includes interengaging means and wherein said electrically conductive means comprises a moveable arm extending in said aperture to engage said interengaging means to hold said rod in said collar.

9. The apparatus as defined in claim 8 wherein said collar is enclosed at one end includes an electrical contact mounted at said enclosed end to engage an end of a rod mounted therein.

10. The apparatus as defined in claim 9 wherein said rod includes an electrical contact at an end for engaging said contact mounted at said enclosed end of said collar.

11. The apparatus as defined in claim 10 wherein said rod is made of an electrically conductive material and said contact at said end thereof is electrically insulated from said rod.

12. The apparatus as defined in claim 11 wherein said rod is hollow and includes a conductor coupled to and extending from said contact at said end of said rod to a visor mounted to said rod.

13. The apparatus as defined in claim 12 wherein said arm comprises a leaf spring and said interengaging means comprises a fitting with a surface engaged by one end of said leaf spring.

14. The apparatus as defined in claim 13 wherein said leaf spring has an opposite end anchored to said base.

15. The apparatus as defined in claim 14 wherein said collar opening includes a keyway extending therealong and said fitting on said rod is a torque fitting having a flange extending into said keyway.

* * * * *